United States Patent [19]

Kim

[11] Patent Number: 4,807,720

[45] Date of Patent: Feb. 28, 1989

[54] LADDER LEVELING ATTACHMENT

[76] Inventor: Soon Y. Kim, 10311 Ranger Rd., Fairfax, Va. 22030

[21] Appl. No.: 144,123

[22] Filed: Jan. 15, 1988

[51] Int. Cl.[4] ..... E06C 7/44

[52] U.S. Cl. ..... 182/205; 248/188.8

[58] Field of Search ..... 182/201, 203, 204, 205, 182/206; 248/188.8

[56] References Cited

U.S. PATENT DOCUMENTS

| | | | |
|---|---|---|---|
| 1,223,367 | 4/1917 | Brown | 182/204 |
| 1,251,192 | 12/1917 | Drummond | 182/204 |
| 1,329,740 | 2/1920 | Barron | 182/205 |
| 1,887,495 | 11/1932 | Carter | 182/205 |
| 2,147,052 | 2/1939 | Noone | 182/205 |
| 3,047,061 | 7/1962 | Wilcox | 182/201 |
| 3,179,206 | 4/1965 | Studer | 182/205 |
| 3,484,814 | 12/1969 | Meehan | 182/204 |
| 3,527,321 | 9/1970 | Brown | 182/205 |
| 3,882,966 | 5/1975 | Fasano | 182/205 |
| 4,014,406 | 3/1977 | Easton | 182/204 |
| 4,085,820 | 4/1978 | Cerny | 182/204 |
| 4,423,797 | 1/1984 | Batten | 182/204 |

*Primary Examiner*—Reinaldo P. Machado
*Attorney, Agent, or Firm*—Dennis H. Lambert

[57] ABSTRACT

A ladder leveling attachment (10) for adjusting the length of one or both legs of a ladder (L) to compensate for uneven surfaces, has a housing (11) with means (12, 13, 14) for securing it to a leg of a ladder, and an extendible leg (15) is telescopically received in the housing for movement inwardly and outwardly of the housing to selectively increase or decrease the length of the leg. A plurality of angled notches or slots (25) are formed in the housing and a spring-biased latching pin (35) is carried by the extendible leg and is adapted to engage in the slots for latching the extendible leg in an adjusted position. The opposite ends (38, 39) of the latching pin project outwardly beyond the opposite sides of the housing and may be grasped in one hand to release the latching pin from the slots to move the extendible leg along channels (24) to a new position. Thereafter, the pin is simply released and the spring urges the pin into seated engagement in adjacent notches (25).

4 Claims, 2 Drawing Sheets

FIG. 1
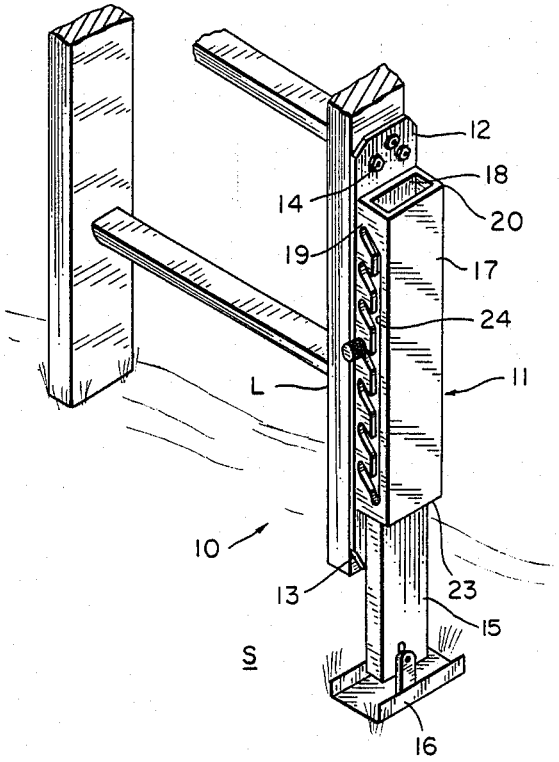
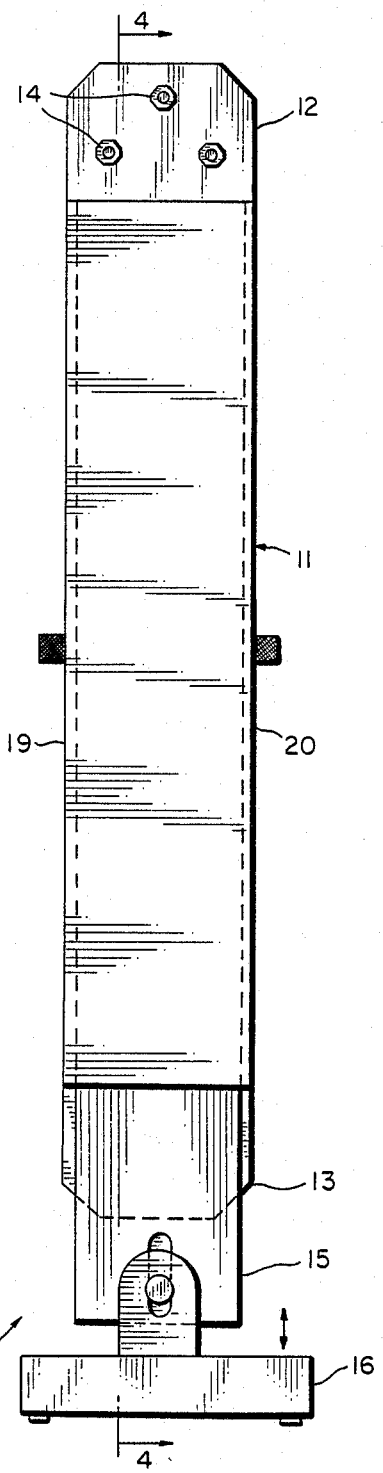
FIG. 2
FIG. 5
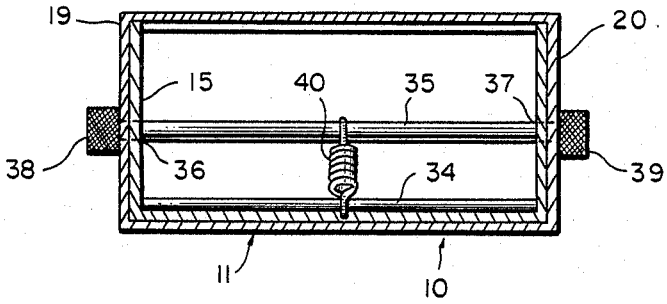

LADDER LEVELING ATTACHMENT

FIELD OF THE INVENTION

This invention relates to attachments for ladders, and more particularly, to a leveling attachment for a ladder.

Prior Art

In the use of ladders and scaffolds, but particularly ladders, uneven surfaces are sometimes encountered. The user must either place some type of block under one of the legs to level the ladder (an unsafe practice), or utilize an adjustment provided on one or both legs to increase the length of one leg relative to the other to compensate for the uneven surface.

Most ladders as manufactured today have an adjustable foot on each leg, whereby the length of one or both legs may be adjusted. However, these built-in adjustable feet have limited range and will not accommodate surfaces which are very uneven. Various devices have therefore been developed in the prior art for increasing the range of ladder leveling devices, scaffolds, etc., as shown in U.S. Pat. Nos. 1,223,367, 1,329,740, 2,147,052, 3,047,061, 3,179,206, 3,484,814, 3,527,321, 3,882,966, 4,014,406, 4,085,,820 and 4,423,797. Some of these prior art devices are permanent parts of the ladder, as manufactured, while others comprise attachments which may be secured to a conventional ladder. Although some of the prior art devices are relatively simple and economical in construction, they may not have suitable reliability in use. Others are ruggedly constructed and could be expected to maintain an adjusted position while in use, but they are expensive and complicated or time consuming to use. It is important that such a device, i.e., an attachment to a ladder for leveling or adjusting the length of the ladder, be relatively lightweight and easy to use, but, more importantly, that it be rugged and reliable in use.

SUMMARY OF THE INVENTION

Accordingly, it is an object of the invention to provide a ladder leveling attachment which is simple and economical in construction, easy to use and reliable in operation.

Another object of the invention is to provide a ladder leveling attachment which may adjusted to different adjusted positions with only one hand, and which remains securely engaged in its adjusted position after it has been adjusted.

A further object of the invention is to provide a ladder leveling attachment which is easy to adjust with one hand, which is simple and economical in construction, which has a large range of adjustment, and which is reliable in use.

These and other objects and advantages of the invention are achieved by the structure of the invention, wherein an attachment housing has means for securing it to a leg of a ladder, and an extendible leg is telescopically received in the housing for movement inwardly and outwardly of the housing to selectively increase or decrease the length of the leg. The extendible leg has a pivoted foot on its bottom for contacting the surface on which the ladder is supported, and the leg is latchable in a plurality of longitudinally adjusted positions relative to the housing. The latching means comprises a plurality of angled notches or slots in the housing and a spring-biased latching pin carried by the extendible leg and adapted to engage in the slots for latching the extendible leg in an adjusted position. The opposite ends of the latching pin project outwardly beyond the opposite sides of the housing and may be grasped in one hand to release the latching pin from the slots to move the extendible leg to a new position. Thereafter, the pin is simply released and the spring urges the pin into seated engagement in notches at opposite sides of the housing.

BRIEF DESCRIPTION OF THE DRAWINGS

The foregoing and other advantages of the invention will become apparent from the following detailed description and appended claims, when taken in conjunction with the drawings, wherein like reference characters designate like parts throughout the several views and wherein:

FIG. 1 is a fragmentary perspective view of a lower end portion of a ladder with the leveling attachment of the invention secured thereto;

FIG. 2 is a side plan view in elevation of the attachment of the invention;

FIG. 5 is a transverse sectional view taken along line 5—5 in FIG. 3;

DESCRIPTION OF THE PREFERRED EMBODIMENTS

Figure 6:
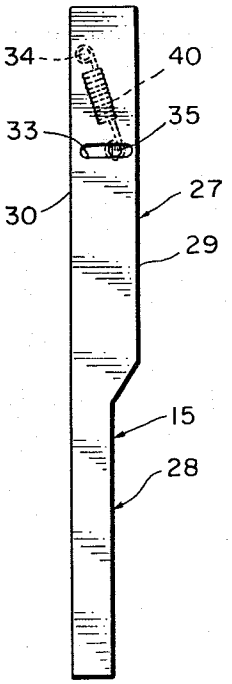
FIG. 6 is a side view in elevation of the extendible leg of attachment of the invention.
Figure 7:
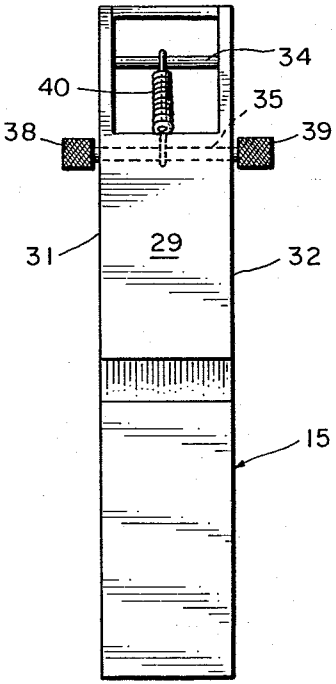
FIG. 7 is a front view in elevation of the extendible leg.
Figure 4:
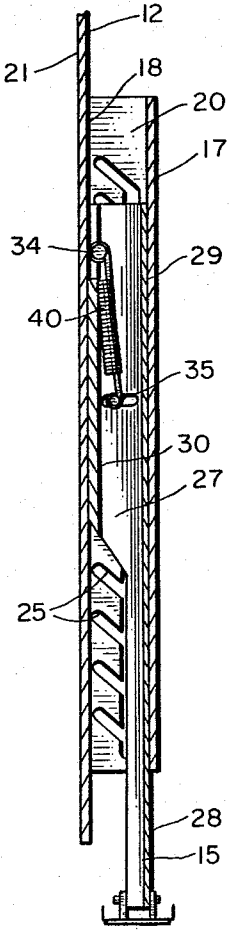
FIG. 4 is a longitudinal sectional view of the attachment, taken along line 4—4 in FIG. 2.
Figure 3:
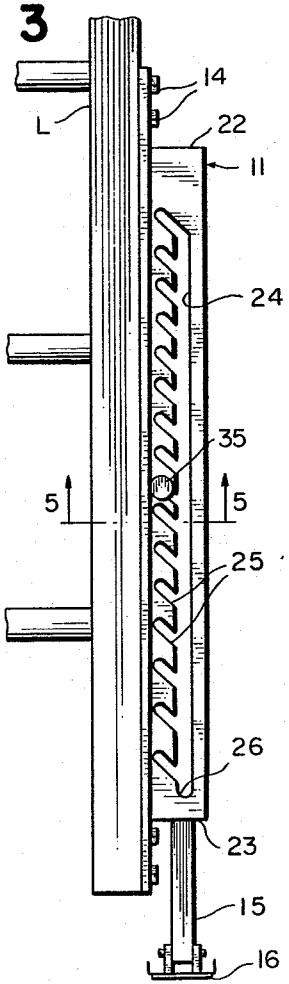
FIG. 3 is an edge plan view in elevation of the attachment of the invention.

Referring more particularly to the drawings, the attachment of the invention is indicated generally at 10, and in FIG. 1 is shown attached to one leg of a ladder L. The attachment comprises an elongate, hollow housing 11 having mounting flanges 12 and 13 projecting from each end thereof, with suitable fastening means such as bolts or the like 14 extended therethrough and into the leg of the ladder. An extendible leg 15 is telescopically engaged in the housing and projects from the housing a desired distance to level the ladder on the uneven surface S. A foot 16 is pivotally mounted on the lower end of the extendible leg 15 for engaging the surface S.

The housing is shaped essentially as a box beam, with a front wall 17, back wall 18 and opposite side walls 19 and 20. The mounting flanges 12 and 13 comprise extensions of the back wall and have a plurality of openings 21 therethrough for receiving the fasteners 14. The opposite ends 22 and 23 of the housing are open, although the upper end 22 could be closed if desired.

The side walls 19 and 20 each have an elongate slot or channel 24 formed therein, extending along substantially the entire length of the side walls, but terminating short of the ends thereof. A plurality of angularly upwardly extending notches 25 communicate at one end with the channel and extend upwardly at their other end into proximity with the back wall. These notches are uniformly spaced along the length of the channel, with the uppermost notch extending upwardly from the upper end of the channel and the lowermost notch being spaced slightly above the lower end of the channel to define a clearance recess 26.

The extendible leg 15 also has a box-like upper end portion 27 extending over approximately twothirds the length of the leg, and a relatively narrower, channel-like lower end 28 which projects beyond the lower open end of the housing. The box-like upper end 27 has a front wall 29, back wall 30 and opposite side walls 31 and 32. The shape and size of the housing and leg are such that the leg slides with close-fitting engagement in the housing. The side walls 31 and 32 each have an elongate slot 33 therein approximately midway the length of the upper portion 27, extending from the back wall 30 toward the front wall 29. A transverse bar or pin 34 extends between the side walls at a location spaced above the slots 33 and positioned closely adjacent the back wall.

An elongate latching pin 35 extends transversely through the housing and leg, with its opposite ends 36 and 37 received in the notches 25 in the housing side walls and the slots 33 in the leg side walls. Roughened finger grips 38 and 39 may be provided on the outer ends of the pin 35, if desired, to facilitate manipulation thereof. A suitable spring means 40 is engaged between the bar or pin 34 and the latching pin 35, tending to urge the pin 35 upwardly and to the rear of the housing. By relieving pressure or weight from the leg 15 and pulling the pin 35 downwardly and outwardly relative to the housing and leg, the pin slides down the angled notches 25 and into the channel 24, while at the same time being constrained to move along the slots 33 in the leg. The pin 35 may then be moved in a desired direction along the channel 24 to extend the leg 15 inwardly or outwardly of the housing to either lengthen or shorten the extension provided by the attachment, and when the desired length is obtained, the pin is released, whereupon the spring 40 urges the pin back into an adjacent notch 25. The upwardly angled shape of the notches assures that the weight or force exerted by the leg when the ladder is supported on the surface S will firmly urge the pin 35 upwardly in the notches 25, and the spring 40 will even maintain the pin in place when weight is removed from the leg.

The housing 11, leg 15 and latching pin 35 may be made of any suitable material, such as steel, and may be provided in any desired size. A typical attachment in accordance with the invention has an overall length of about 23 inches when fully telescoped together, and a width of about three inches. In this configuration, the extendible leg 15 would have a length of about 23 inches, whereby a sufficient portion thereof would remain inside the housing to lend adequate strength to the attachment when the leg is fully extended.

Although the invention has been described with reference to a particular embodiment, it is to be understood that this embodiment is merely illustrative of the application of the principles of the invention. Numerous modifications may be made therein and other arrangements may be devised without departing from the spirit and scope of the invention.

I claim:

1. A ladder leveling attachment, comprising:

a hollow housing having an upper end and a lower end and having mounting means on the upper and lower ends thereof for attaching the housing to the leg of a ladder, said housing having a front wall, opposite side walls and a back wall which is disposed adjacent the leg of a ladder when the attachment is in use, an elongate channel in each of the opposite side walls extending along the length of the housing, and a plurality of upwardly angled notches in each side wall, communicating at one end with a respective channel and extending at their other end into close proximity with the back wall;

an extendible leg telescopically received in the housing and having a lower end projecting beyond the lower end of the housing for engaging a surface on which the ladder is placed; and a latching pin carried by the extendible leg and extending transversely through the housing and leg, with opposite ends received in the notches in the housing to latch the leg in an adjusted position relative to the housing and ladder, said pin being movable out of said notches and into and along said channels for movement into a different notch to latch said extendible leg in a different adjusted position.

2. A ladder leveling attachment as claimed in claim 1, wherein:

spring means is engaged with said latching pin to urge it into the notches in the housing side wall.

3. A ladder leveling attachment as claimed in claim 2, wherein:

the extendible leg has a front wall, a back wall and opposite side walls with a size and shape to be closely slidably received in the housing; and said side walls have elongate slots therein extending from the back wall toward the front wall, said latching pin being received in said slots, and said slots having a length to enable said latching pin to be disengaged from the notches in the housing side walls.

4. A ladder leveling attachment as claimed in claim 3, wherein:

a spring retaining bar extends between the side walls of the extendible leg closely adjacent the back wall thereof and spaced upwardly of the slots and latching pin, said spring means comprising a coil spring having one end attached to the spring retaining bar and the other end attached to the latching pin, whereby the spring urges the latching pin upwardly and rearwardly with respect to the housing and extendible leg.

* * * * *